US008813448B1

(12) United States Patent
Rensi

(10) Patent No.: US 8,813,448 B1
(45) Date of Patent: Aug. 26, 2014

(54) ADJUSTABLE RIGID CORNER BEAD

(71) Applicant: Karen Ann Rensi, Grosse Ile, MI (US)

(72) Inventor: Karen Ann Rensi, Grosse Ile, MI (US)

( * ) Notice: Subject to any disclaimer, the term of this patent is extended or adjusted under 35 U.S.C. 154(b) by 0 days.

(21) Appl. No.: 14/073,972

(22) Filed: Nov. 7, 2013

Related U.S. Application Data

(60) Provisional application No. 61/863,960, filed on Aug. 9, 2013.

(51) Int. Cl.
*E04F 13/02* (2006.01)
*E04F 13/06* (2006.01)
*E04F 19/02* (2006.01)

(52) U.S. Cl.
CPC ..... *E04F 13/06* (2013.01); *E04F 19/028* (2013.01); *E04F 2013/063* (2013.01); *E04F 13/068* (2013.01)
USPC ..... 52/255; 52/741.41; 52/417; 16/225; 16/234; 156/71

(58) Field of Classification Search
CPC .... E04F 13/06; E04F 13/068; E04F 2013/063
USPC ..... 52/254–257, 287.1, 288.1, 417, 716.1, 52/741.41; 16/225, 234
See application file for complete search history.

(56) References Cited

U.S. PATENT DOCUMENTS

| | | | | | |
|---|---|---|---|---|---|
| 923,430 | A * | 6/1909 | Hannon | 52/255 |
| 1,212,740 | A * | 1/1917 | Clark | 52/257 |
| 1,247,627 | A * | 11/1917 | Braddock | 52/257 |
| 1,728,461 | A * | 9/1929 | Wolcott | 52/257 |
| 1,769,813 | A * | 7/1930 | Winter | 52/255 |
| 3,090,087 | A * | 5/1963 | Miller | 52/287.1 |
| 3,201,820 | A * | 8/1965 | Desrosiers | 16/277 |
| 3,216,053 | A * | 11/1965 | Felix | 16/380 |
| 4,231,135 | A * | 11/1980 | Fradin | 16/225 |
| 5,355,555 | A * | 10/1994 | Zarelius | 16/225 |
| 5,613,335 | A * | 3/1997 | Rennich et al. | 52/255 |
| 6,073,406 | A * | 6/2000 | Kearney | 52/287.1 |
| 6,223,486 | B1 | 5/2001 | Dunham | |
| 6,332,296 | B1 | 12/2001 | Moscovitch | |
| 6,447,872 | B1 | 9/2002 | Larson | |
| 6,615,557 | B2 * | 9/2003 | Smythe, Jr. | 52/287.1 |
| 6,722,092 | B2 * | 4/2004 | Kunz et al. | 52/255 |
| 7,013,610 | B2 * | 3/2006 | Kunz | 52/255 |
| 7,290,310 | B2 * | 11/2007 | Yamaguchi | 16/273 |
| 7,673,428 | B1 | 3/2010 | Smythe | |
| 8,707,518 | B2 * | 4/2014 | Branning | 16/273 |
| 2006/0005489 | A1 * | 1/2006 | Smythe | 52/287.1 |
| 2006/0059809 | A1 | 3/2006 | Smythe, Jr. | |
| 2006/0107490 | A1 * | 5/2006 | Pacholke | 16/234 |
| 2007/0107336 | A1 | 5/2007 | Conboy | |
| 2011/0289873 | A1 * | 12/2011 | Smythe, Jr. | 52/255 |

* cited by examiner

*Primary Examiner* — Robert Canfield
(74) *Attorney, Agent, or Firm* — Vivacqua Law, PLLC; Vincent N. Mastrogiacomo

(57) ABSTRACT

An adjustable corner bead apparatus for aid in the construction of interior wall is provided, the apparatus including a first and a second elongated flange and a corner rod member. Each flange includes a first edge, a second edge opposite the first edge, and a plurality of axially aligned cylinders. Each of the plurality of cylinders are disposed on the first edge of each flange, each of the plurality of cylinders includes an axially aligned bore therethrough. The first and second flanges are disposed such that the first edge of the first flange is proximate the first edge of the second flange and the plurality of cylinders of the first flange are aligned coaxially with the plurality of cylinders of the second flange. The corner rod member is disposed in each bore of the plurality of cylinders of the first and second flanges.

19 Claims, 5 Drawing Sheets

ADJUSTABLE RIGID CORNER BEAD

CROSS-REFERENCE TO RELATED APPLICATIONS

This nonprovisional application claims the benefit of U.S. Provisional Application No. 61/863,960, filed on Aug. 9, 2013, which is hereby incorporated in its entirety herein by reference.

FIELD

The present invention relates generally to drywall or gypsum board construction and more particularly to an apparatus for finishing corners on interior walls constructed of drywall or gypsum board.

BACKGROUND

The statements in this section merely provide background information related to the present disclosure and may or may not constitute prior art.

In interior wall construction using drywall or gypsum board, a cornering member is required to aid in finishing corners and obtaining a straight corner and mask or cover-up the imperfections of the wall. Using the corner member that is adhered to or otherwise attached to the drywall at a corner, joint compound or other type of plaster is applied over the corner member and wall to achieve a smooth surface and a straight corner. The process is repeated until a smooth surface and straight or "crisp" corner is achieved. Using this process with a traditional cornering member may require multiple applications of joint compound and sanding cycles. Additionally, the degree of the straightness of the corner depends largely on the original condition of the drywall and even the quality of the stud wall on which the drywall is attached.

However, the traditional use of a corner member and joint compound includes several inefficiencies and quality issues due to the lack of stiffness of traditional corner members. For example, depending on how the corner member is attached to the wall, the traditional corner member follows the contour of the wall and thus results in multiple applications of joint compound, excessive use of time waiting for the joint compound to dry, and additional labor in applying the joint compound and sanding multiple times. Still, the additional time, materials, and labor may not yield a quality, straight, and crisp corner. Therefore, there is a need for a new corner bead apparatus that overcomes the shortfalls of traditional corner members used in interior drywall construction.

SUMMARY

An adjustable corner bead apparatus is provided having a first and a second elongated flange and a corner rod. Each flange has a first edge, a second edge opposite the first edge, a first surface, a second surface opposite the first surface, and a plurality of axially aligned cylinders, and wherein each of the plurality of cylinders are disposed on the first edge of each flange. Each of the plurality of cylinders includes an axially aligned bore therethrough. The first and second flanges are disposed such that the first edge of the first flange is proximate the first edge of the second flange and the plurality of cylinders of the first flange are aligned coaxially with the plurality of cylinders of the second flange. The corner rod member is disposed in each bore of the plurality of cylinders of the first and second flanges.

In another example of the present invention, the adjustable corner bead apparatus further includes a first and a second flexible paper member having a first and a second portion. The first portion of the first flexible paper member is adhered to the first flange proximate the second edge and the first portion of the second flexible paper member is adhered to the second flange proximate the second edge.

In yet another example of the present invention, the first portion of the first flexible paper member is adhered to the first surface of the first elongated flange and the first portion of the second flexible paper member is adhered to the first surface of the second elongated flange.

In yet another example of the present invention, each of the first and second elongated flanges further include at least one strengthening rib formed on at least one of the first surface and second surface.

In yet another example of the present invention, each of the first and second elongated flanges further include a plurality of holes connecting the first surface of the flanges to the second surface of the flanges.

In yet another example of the present invention, the first and second flanges further include a first and a second end, the corner rod further includes a first and a second end, the first end of the corner rod extends beyond the first ends of the first and second flanges, and the second end of the corner rod is recessed with respect to the second ends of the first and second flanges.

In yet another example of the present invention, a method for installing an adjustable corner bead apparatus onto a first and second substrate forming a corner is provided. The adjustable corner bead apparatus includes a first and a second elongated flange and a corner rod. Each flange having a first edge, a second edge opposite the first edge, a first surface, a second surface opposite the first surface, and a plurality of axially aligned cylinders. Each of the plurality of cylinders are disposed on the first edge of each flange. Each of the plurality of cylinders includes an axially aligned bore therethrough. The first and second flanges are disposed such that the first edge of the first flange is proximate the first edge of the second flange and the plurality of cylinders of the first flange are aligned coaxially with the plurality of cylinders of the second flange. The corner rod member is disposed in each bore of the plurality of cylinders of the first and second flanges.

In yet another example of the present invention, the method includes a first through sixth steps. The first step includes applying a joint compound to the first and second substrates. The second step includes disposing the first flange on the joint compound of the first substrate. The third step includes rotating the second flange relative to the first flange and disposing the second flange on the joint compound of the second substrate. The fourth step includes applying a filler compound on to the flanges and substrates. The fifth step includes removing excess filler compound after the compound has hardened. The sixth step includes repeating the third and fourth steps until a finished surface is smooth and free of imperfections.

In yet another example of the present invention, the adjustable corner bead apparatus further includes a first and a second flexible paper member having a first and a second portion. The first portion of the first flexible paper member is adhered to the first flange proximate the second edge and the first portion of the second flexible paper member is adhered to the second flange proximate the second edge.

In yet another example of the present invention, the first portion of the first flexible paper member is adhered to the first surface of the first elongated flange, the second portion of the first flexible paper member is disposed on the joint compound of the first substrate, the first portion of the second flexible paper member is adhered to the first surface of the second elongated flange, and the second portion of the second flexible paper member is disposed on the joint compound of the second substrate.

In yet another example of the present invention, each of the first and second elongated flanges further include at least one strengthening rib formed on at least one of the first surface and second surface.

In yet another example of the present invention, each of the first and second elongated flanges further include a plurality of holes connecting the first surface of the flanges to the second surface of the flanges and the flanges are attached to the substrate using a fastener disposed through each of the plurality of holes and in the respective substrate.

In yet another example of the present invention, the first and second flanges of the adjustable the corner bead apparatus further includes a first and a second end, the corner rod further includes a first and a second end, the first end of the corner rod extends beyond the first ends of the first and second flanges, and the second end of the corner rod is recessed with respect to the second ends of the first and second flanges.

In yet another example of the present invention, a wall assembly for the interior of a building is provided. The wall assembly includes a first and a second wall panel each having a first end, a second end opposite the first end, and an outer continuous surface, and an adjustable corner bead apparatus. The first end of the first wall is disposed adjacent the first end of the second wall and the outer continuous surface of the first wall is adjacent the outer continuous surface of the second wall forming a seam. The adjustable corner bead apparatus includes a first and a second elongated flange, and a corner rod member, each flange having a first edge, a second edge opposite the first edge, a first surface, a second surface opposite the first surface, and a plurality of axially aligned cylinders. Each of the plurality of cylinders are disposed on the first edge of each flange. Each of the plurality of cylinders includes an axially aligned bore therethrough. The first and second flanges are disposed such that the first edge of the first flange is proximate the first edge of the second flange and the plurality of cylinders of the first flange are aligned coaxially with the plurality of cylinders of the second flange. The corner rod member is disposed in each bore of the plurality of cylinders of the first and second flanges. The first flange of the corner bead apparatus is fixed to the outer continuous surface of the first wall proximate the seam and the second flange of the corner bead apparatus is fixed to the outer continuous surface of the second wall proximate the seam.

In yet another example of the present invention, the outer continuous surfaces of the first and second wall panels form a corner having an angle.

In yet another example of the present invention, the corner is one of an inside corner and an outside corner.

In yet another example of the present invention, the angle is a right angle.

In yet another example of the present invention, the angle is an obtuse angle.

In yet another example of the present invention, the angle is an acute angle.

In yet another example of the present invention, the wall assembly further includes a copious amount of joint compound disposed on the outer continuous surface of the wall panels and the adjustable corner bead apparatus to form a smooth continuous surface.

In yet another example of the present invention, the first and second elongated flanges of the adjustable corner bead apparatus each further include at least one strengthening rib formed on at least one of the first surface and second surface.

Further objects, aspects and advantages of the present invention will become apparent by reference to the following description and appended drawings wherein like reference numbers refer to the same component, element or feature.

DRAWINGS

The drawings described herein are for illustration purposes only and are not intended to limit the scope of the present disclosure in any way;

DETAILED DESCRIPTION

The following description is merely exemplary in nature and is not intended to limit the present disclosure, application, or uses.

Figure 1:
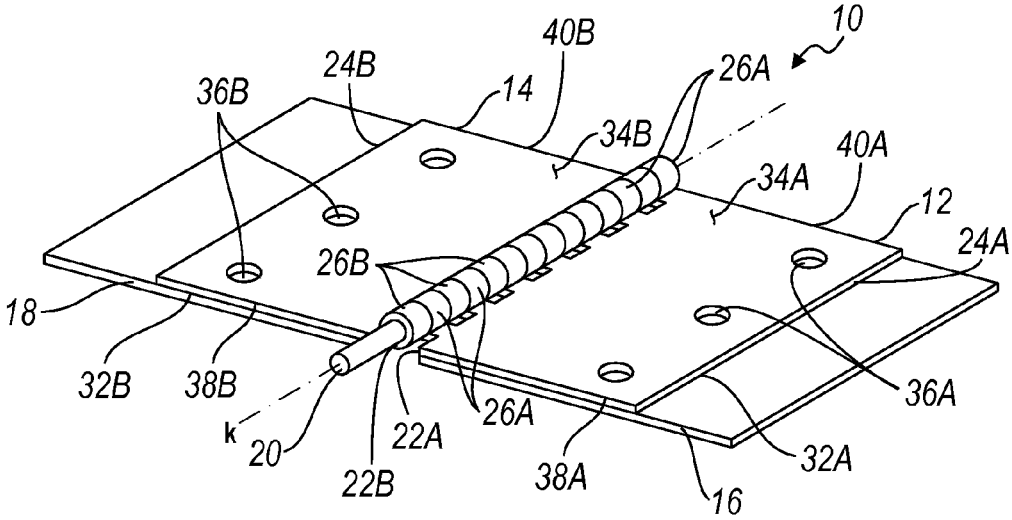
FIG. 1 is a perspective view of an embodiment of an adjustable corner bead according to the present invention.
Figure 2:
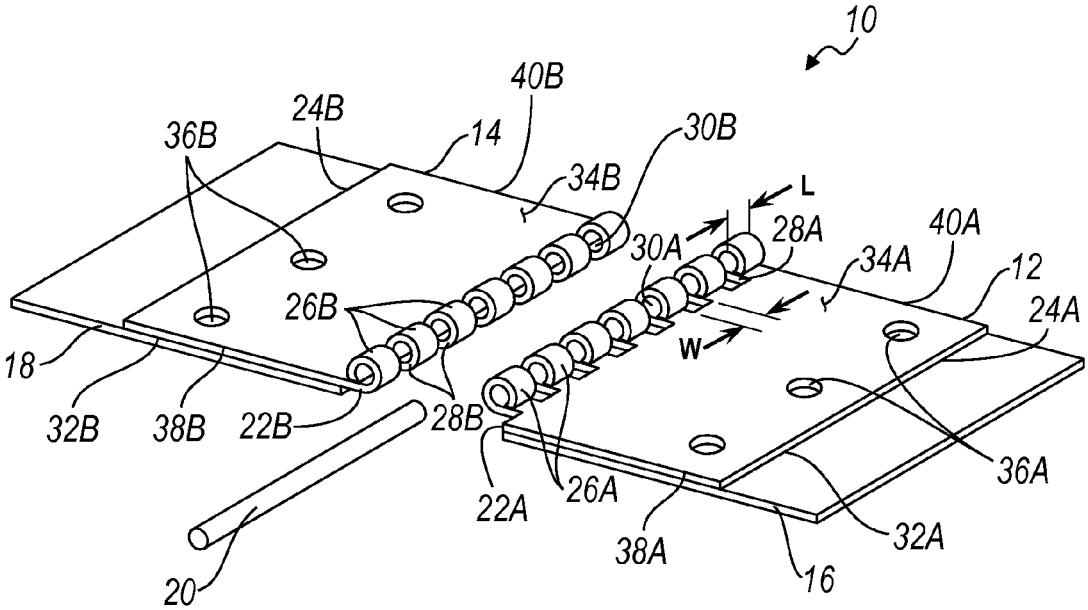
FIG. 2 is an exploded perspective view of an embodiment of an adjustable corner bead according to the present invention.

Referring to the drawings, wherein like reference numbers refer to like components, in FIGS. 1 and 2 an adjustable corner bead apparatus 10 is illustrated and will now be described. The adjustable corner bead apparatus 10 includes a first and a second elongated flanges 12, 14, a first and a second paper strip 16, 18, and a corner rod 20. In a preferred embodiment of the present invention, the first and second flanges 12, 14 each include a first edge 22A, 22B and a second edge 24A, 24B opposite the first edge 22A, 22B, a first surface 32A, 32B and a second surface 34A, 34B opposite the first surface, a plurality of bores or holes 36A, 36B, and a first and a second end 38A, 38B, 40A, 40B. The first edges 22A, 22B includes a plurality of equally spaced and equally sized cylinders 26A, 26B aligned coaxially with an axis k which is further parallel with the first edges 22A, 22B. Between each of the individual cylinders 26A, 26B is a gap 28A, 28B. An axial length L of the cylinders 26A, 26B is equal to the length W of the gaps 28A, 28B between the cylinders 26A, 26B. In this manner, as the first and second flanges 12, 14 are assembled the cylinders 26A of the first flange 12 are disposed in the gaps 28B of the second flange 14. Likewise, the cylinders 26B of the second flange 14 are disposed in the gaps 28A of the first flange 12. Each of the cylinders 26A, 26B of both the first and second flanges 12, 14 include an axially aligned bore 30A, 30B. Since each of the bores 30A, 30B of each cylinder 26A, 26B are aligned axially once assembled, the corner rod 20 is disposed in each of the bores 30A, 30B thus interlocking the first and second flanges 12, 14 while still allowing relative rotational movement between the flanges 12, 14 around the axis k. Additionally, the corner rod 20 may be installed such that a first end 20A of the corner rod 20 extends beyond the first ends 38A, 40A of the first and second flanges 12, 14 and a second end 20B of the corner rod 20 is recessed from the second ends 38B, 40B of the first and second flanges 12, 14. In this manner, a number of adjustable corner bead apparatus 10 can be installed end to end while having a continuous connection between each apparatus 10

The first paper strip 16 is attached to the first surface 32A of the first flange 12. The second paper strip 18 is attached to the first surface 32B of the second flange 14. Each of the paper strips 16, 18 are disposed partially on the first surface 32A, 32B of the flanges 12, 14 and partially overhanging the second edge 24A, 24B of the flanges 12, 14.

Figure 3A:
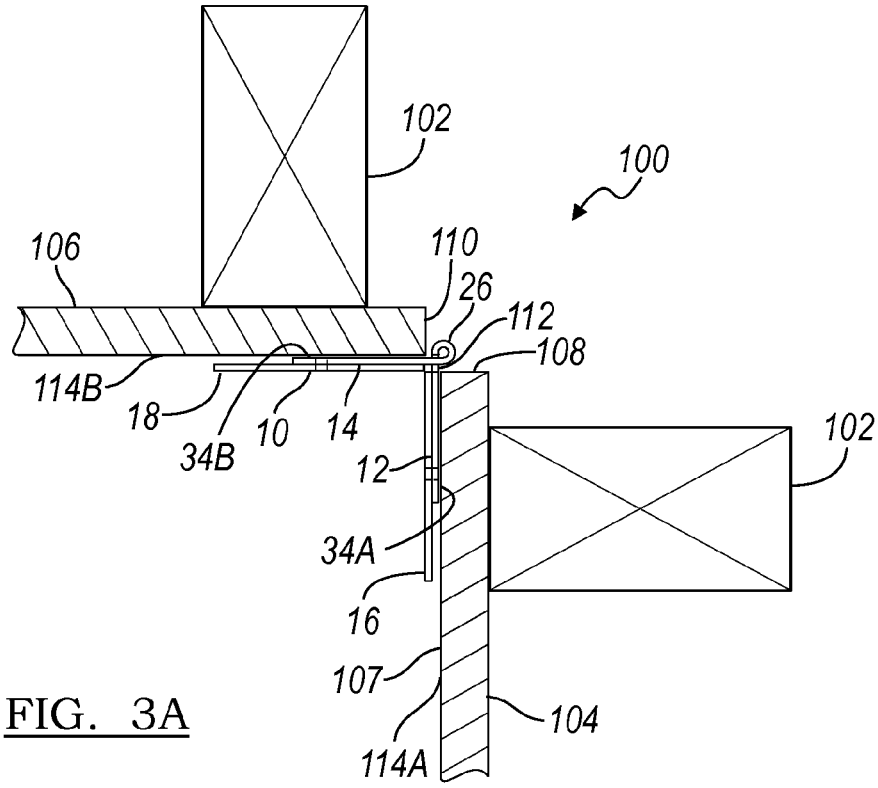
FIG. 3A is a cross-section of a 90° inside corner including an adjustable corner bead according to the present invention.

Referring now to FIG. 3A, the adjustable corner bead apparatus 10 is illustrated installed in a wall assembly 100 and will now be described with reference numbers similar elements being continued from FIGS. 1 and 2. For example, FIG. 3A shows an inside wall assembly 100 having a right angle corner including wood or steel stud 102 construction, a first and second sheet of drywall 104, 106, and joint compound 107. Each of the drywall sheets 104, 106 include a first edge 108, 110. The first edges 108, 110 are disposed proximate each other when the drywall sheets 104, 106 are attached to the studs 102. A small gap 112 between the first edges 108, 110 runs the length of the sheets of drywall 104, 106. A first coating of a joint compound is applied to the sheets of drywall 104, 106 proximate the first edges 108, 110 such that the overhanging portion of the paper strips 16, 18 is in contact with the joint compound. The corner bead apparatus 10 is disposed on the joint compound such that an assembled portion including the cylinders 26 and corner rod 20 are disposed in the gap 112 between the drywall sheets 104, 106. Further, the second surfaces 34A, 34B of each of the flanges 12, 14 are adjacent to an outer surface 114A, 114B of the drywall sheets 104, 106 respectively. The portion of the paper strips 16, 18 which overhang the flanges 12, 14 are attached to the outer surfaces 114A, 114B of the drywall sheets 104, 106. However, other methods of attaching the corner bead apparatus 10 to the drywall are possible without departing from the scope of the invention. For example, the holes 36A, 36B (shown in FIGS. 1 and 2) in the flanges 12, 14 may be used to drive a tack or nail through to attach the flanges 12, 14 to the drywall sheets 104, 106.

Figure 3B:
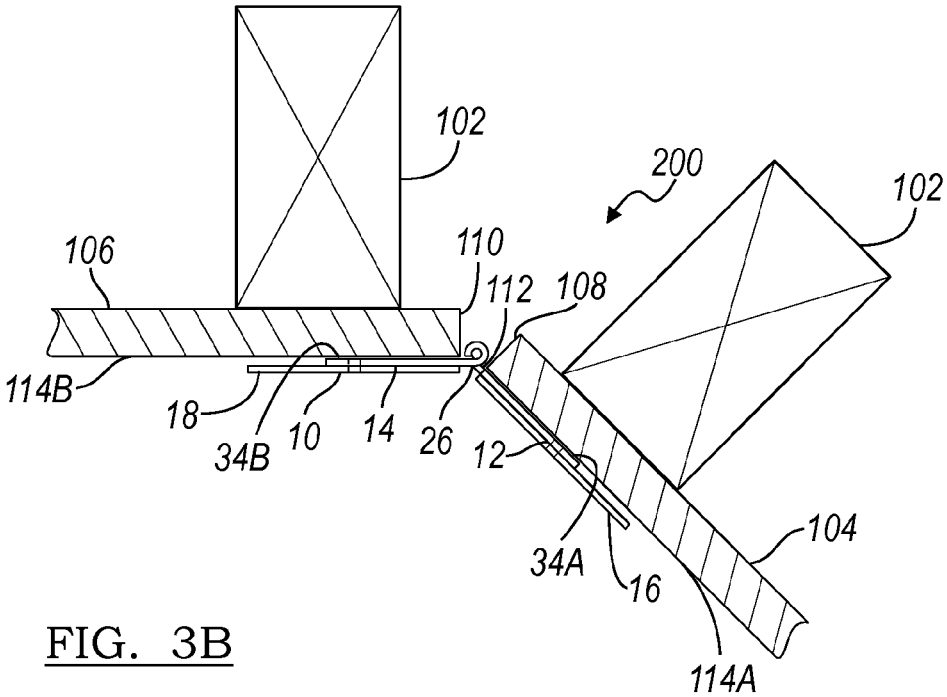
FIG. 3B is a cross-section of a greater than 90° inside corner including an adjustable corner bead according to the present invention.
Figure 3C:
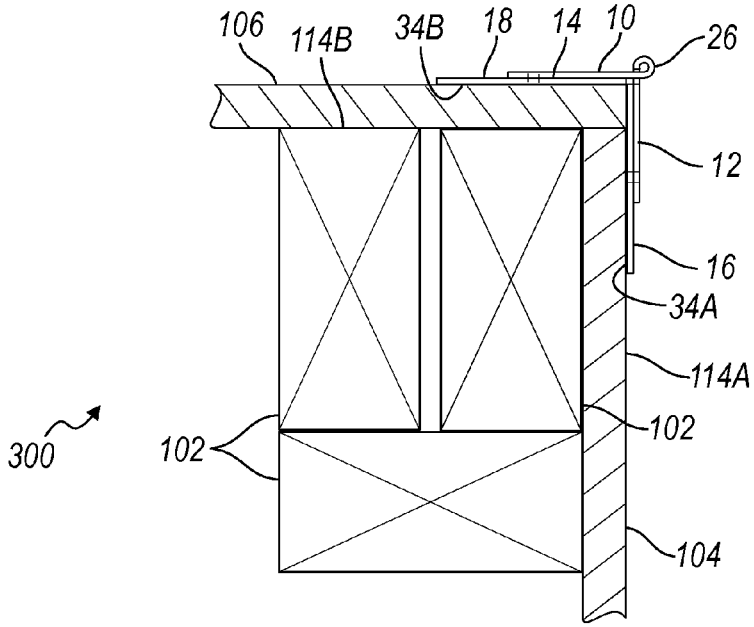
FIG. 3C is a cross-section of a 90° outside corner including an adjustable corner bead according to the present invention.
Figure 3D:
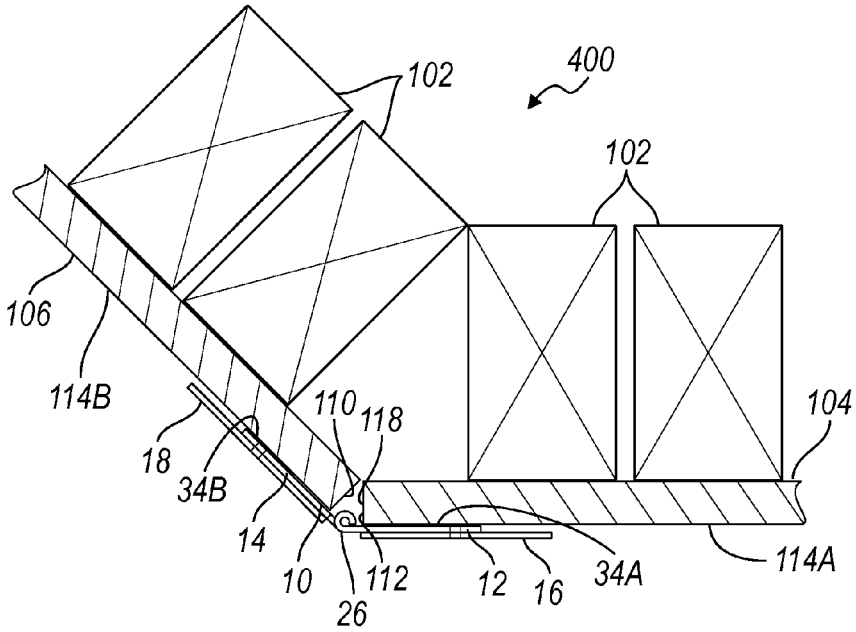
FIG. 3D is a cross-section of a less than 90° outside corner including an adjustable corner bead according to the present invention.

In other examples, FIGS. 3B-D illustrate the adjustable corner bead apparatus 10 installed in a series of wall assemblies 200, 300, 400 which will now be described. In particular, FIG. 3B shows the corner bead apparatus 10 installed on an inside corner 200 of a wall forming an acute angle. FIG. 3C shows the corner bead apparatus 10 installed on an outside corner 300 of a wall forming right angle. FIG. 3D shows the corner bead apparatus 10 installed on an outside corner 400 of a wall forming an obtuse angle. Also, the corner bead apparatus 10 can be applied to wall-to-ceiling junctions or any other wall transition without departing from the scope of the invention.

Figure 4:
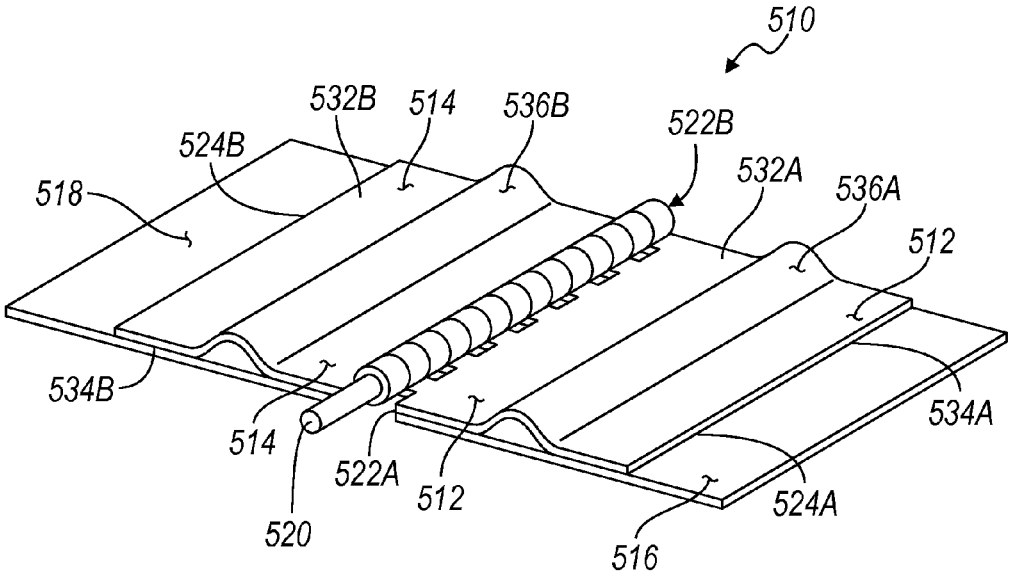
FIG. 4 is a perspective view of another embodiment of an adjustable corner bead according to the present invention.

Referring now to FIG. 4, another example of the present invention is illustrated and will now be described. An adjustable corner bead apparatus 510 is shown including a first and a second elongated flange 512, 514, a first and a second paper strip 516, 518, and a corner rod 520. In a preferred embodiment of the present invention, the first and second flanges 512, 514 each include a first edge 522A, 522B and a second edge 524A, 524B opposite the first edge 522A, 522B and a first surface 532A, 532B and a second surface 534A, 534B opposite the first surface. The first and second flanges 512, 514 also include at least one rib 536A, 536B disposed on the surfaces 532A, 532B of the flanges 512, 514 which improves the overall stiffness of the flanges 512, 514.

Figure 5:
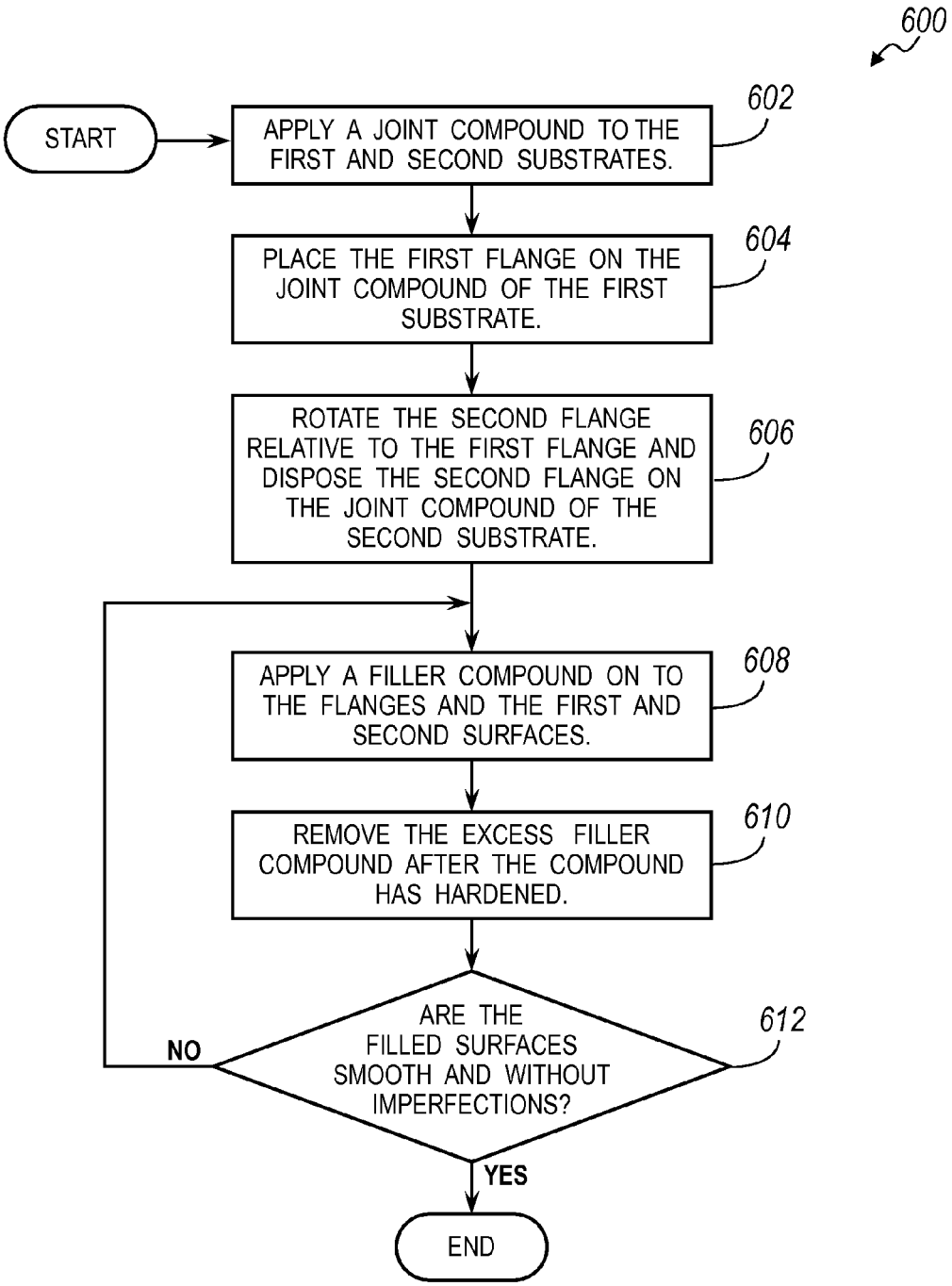
FIG. 5 is a flowchart depicting a method for installing an adjustable corner bead apparatus according to the present invention.

Referring now to FIG. 5, a flow chart depicting a method 600 for installing an adjustable corner bead apparatus onto the corner of a wall is illustrated and will now be described. For example, a first step 602 of the method includes applying a joint compound to the first and second substrates. A second step 604 of the method includes placing the first flange on the joint compound of the first substrate. The third step 606 of the method includes rotating the second flange relative to the first flange of the corner bead apparatus and placing the second flange on the joint compound of the second substrate. A fourth step 608 of the method includes applying additional joint compound on to the flanges and the first and second surfaces. A fifth step 610 of the method removes the excess filler compound after the compound has hardened. A fifth step 610 of the method repeats the third and fourth steps until a desired result is achieved.

The description of the invention is merely exemplary in nature and variations that do not depart from the gist of the invention are intended to be within the scope of the invention. Such variations are not to be regarded as a departure from the spirit and scope of the invention.

What is claimed is:

1. An adjustable corner bead apparatus, the apparatus including:

a first and a second elongated flange, each flange having a first edge, a second edge opposite the first edge, a first surface, a second surface opposite the first surface, and a plurality of axially aligned cylinders, and wherein each of the plurality of cylinders are disposed on the first edge of each flange, each of the plurality of cylinders includes an axially aligned bore therethrough, and the first and second flanges are disposed such that the first edge of the first flange is proximate the first edge of the second flange and the plurality of cylinders of the first flange are aligned coaxially with the plurality of cylinders of the second flange;

a corner rod member is disposed in each bore of the plurality of cylinders of the first and second flanges; and further including a first and a second flexible paper member having a first and a second portion, and wherein the first portion of the first flexible paper member is adhered to the first flange proximate the second edge and the first portion of the second flexible paper member is adhered to the second flange proximate the second edge.

2. The adjustable corner bead apparatus of claim 1 wherein the first portion of the first flexible paper member is adhered to the first surface of the first elongated flange and the first portion of the second flexible paper member is adhered to the first surface of the second elongated flange.

3. The adjustable corner bead apparatus of claim 1 wherein each of the first and second elongated flanges further include at least one strengthening rib formed on at least one of the first surface and second surface.

4. The adjustable corner bead apparatus of claim 1 wherein each of the first and second elongated flanges further include a plurality of holes connecting the first surface of the flanges to the second surface of the flanges.

5. The adjustable corner bead apparatus of claim 1 wherein the first and second flanges further include a first and a second end, the corner rod further includes a first and a second end, the first end of the corner rod extends beyond the first ends of the first and second flanges, and the second end of the corner rod is recessed with respect to the second ends of the first and second flanges.

6. A method for installing an adjustable corner bead apparatus onto a first and second substrate that form a corner, the adjustable corner bead apparatus including:

a first and a second elongated flange, each flange having a first edge, a second edge opposite the first edge, a first surface, a second surface opposite the first surface, and a plurality of axially aligned cylinders, and wherein each of the plurality of cylinders are disposed on the first edge of each flange, each of the plurality of cylinders includes an axially aligned bore therethrough, and the first and second flanges are disposed such that the first edge of the first flange is proximate the first edge of the second flange and the plurality of cylinders of the first flange are aligned coaxially with the plurality of cylinders of the second flange;

a corner rod member is disposed in each bore of the plurality of cylinders of the first and second flanges; and the method including:

a first step for applying a joint compound to the first and second substrates;

a second step for disposing the first flange on the joint compound of the first substrate;

a third step for rotating the second flange relative to the first flange and disposing the second flange on the joint compound of the second substrate;

a fourth step for applying a filler compound on to the flanges and substrates;

a fifth step of removing excess filler compound after the compound has hardened;

a sixth step of repeating the third and fourth steps until a finished surface is smooth and free of imperfections.

7. The method for installing the adjustable corner bead apparatus of claim 6 the adjustable corner bead apparatus further including a first and a second flexible paper member having a first and a second portion, and wherein the first portion of the first flexible paper member is adhered to the first flange proximate the second edge and the first portion of the second flexible paper member is adhered to the second flange proximate the second edge.

8. The method for installing the adjustable corner bead apparatus of claim 7 wherein the first portion of the first flexible paper member is adhered to the first surface of the first elongated flange, the second portion of the first flexible paper member is disposed on the joint compound of the first substrate, the first portion of the second flexible paper member is adhered to the first surface of the second elongated flange, and the second portion of the second flexible paper member is disposed on the joint compound of the second substrate.

9. The method for installing adjustable corner bead apparatus of claim 6 wherein each of the first and second elongated flanges further include at least one strengthening rib formed on at least one of the first surface and second surface.

10. The method for installing adjustable corner bead apparatus of claim 6 wherein each of the first and second elongated flanges further include a plurality of holes connecting the first surface of the flanges to the second surface of the flanges and the flanges are attached to the substrate using a fastener disposed through each of the plurality of holes and in the respective substrate.

11. The method for installing adjustable corner bead apparatus of claim 6 wherein the first and second flanges of the adjustable the corner bead apparatus further includes a first and a second end, the corner rod further includes a first and a second end, the first end of the corner rod extends beyond the first ends of the first and second flanges, and the second end of the corner rod is recessed with respect to the second ends of the first and second flanges.

12. A wall assembly for the interior of a building, the wall assembly including:

a first and a second wall panel each having a first end, a second end opposite the first end, and an outer continuous surface, and wherein the first end of the first wall is disposed adjacent the first end of the second wall and the outer continuous surface of the first wall is adjacent the outer continuous surface of the second wall forming a seam;

an adjustable corner bead apparatus having a first and a second elongated flange, and a corner rod member, each flange having a first edge, a second edge opposite the first edge, a first surface, a second surface opposite the first surface, and a plurality of axially aligned cylinders, and wherein each of the plurality of cylinders are disposed on the first edge of each flange, each of the plurality of cylinders includes an axially aligned bore therethrough, the first and second flanges are disposed such that the first edge of the first flange is proximate the first edge of the second flange and the plurality of cylinders of the first flange are aligned coaxially with the plurality of cylinders of the second flange, and the corner rod member is disposed in each bore of the plurality of cylinders of the first and second flanges;

wherein the first flange of the corner bead apparatus is fixed to the outer continuous surface of the first wall proximate the seam and the second flange of the corner bead apparatus is fixed to the outer continuous surface of the second wall proximate the seam.

13. The wall assembly of claim 12 wherein the outer continuous surfaces of the first and second wall panels form a corner having an angle.

14. The wall assembly of claim 13 wherein the corner is one of an inside corner and an outside corner.

15. The wall assembly of claim 13 wherein the angle is a right angle.

16. The wall assembly of claim 13 wherein the angle is an obtuse angle.

17. The wall assembly of claim 13 wherein the angle is an acute angle.

18. The wall assembly of claim 13 further including a copious amount of joint compound disposed on the outer continuous surface of the wall panels and the adjustable corner bead apparatus to form a smooth continuous surface.

19. The wall assembly of claim 13 wherein the first and second elongated flanges of the adjustable corner bead apparatus each further include at least one strengthening rib formed on at least one of the first surface and second surface.

* * * * *